United States Patent [19]

Lew

[11] Patent Number: 4,674,961

[45] Date of Patent: Jun. 23, 1987

[54] SWEEPING TUBULAR DIAPHRAGM PUMP AND MOTOR

[76] Inventor: Hyok S. Lew, 7890 Oak St., Arvada, Colo. 80005

[21] Appl. No.: 358,010

[22] Filed: Mar. 15, 1982

[51] Int. Cl.[4] ..... F04B 43/08

[52] U.S. Cl. ..... 417/477

[58] Field of Search ..... 417/476, 477; 418/45

[56] References Cited

U.S. PATENT DOCUMENTS 3,628,898 12/1971 Bragdon ..... 418/45

3,677,668 7/1972 Rosenberg ..... 418/45

*Primary Examiner*—Carlton R. Croyle

*Assistant Examiner*—T. Olds

[57] ABSTRACT

This invention relates to a pump and hydraulic or pneumatic motor comprising a flexible tubular shell enclosed within a closed rigid cylindrical shell of oblong circular cross section wherein said flexible tubular shell is stretched around four revolving rollers, each pair of said four revolving rollers are diametrically and rotatably disposed about each of two drive shafts located on the plane including the major axis of said oblong circular cross section at two diametrically opposite position with respect to the plane including the minor axis of said oblong circular cross section. Said two pairs of the revolving rollers are linked to one another to rotate in two opposite directions at the same phase, which motion of the revolving rollers generates a cyclically repeating movement on said flexible tubular shell substantially equal to the advancing motion of the tubular diaphragm propagating in the direction parallel to the minor axis of said oblong circular cross section of the rigid cylindrical shell, which movement is employed for pumping or motor action.

2 Claims, 10 Drawing Figures

SWEEPING TUBULAR DIAPHRAGM PUMP AND MOTOR

The primary object of the present invention is to provide a high volume positive displacement pump or motor.

Another object of the present invention is to provide a hydraulic or pneumatic motor delivering a high torque at the low or medium pressure.

A further object of the present invention is to provide a pump or motor that does not use any rubbing motion other than the seal on the drive shaft.

Yet another object of the present invention is to provide a pump or motor employing a simple and inexpensive construction.

Yet a further object of the present invention is to provide a positive displacement pump of the continuous pumping action or motor of the continuous torque.

Still another object of the present invention is to provide a pump suitable for pumping the thick particulate media.

Still a further object of the present invention is to provide a mixer-pump combination usable in conjunction with fluid or pseudofluid media difficult to mix and agitate.

These and other objects of the present invention will become clear as the description thereof proceeds. The present invention may be described with a great clarity and specificity by refering to the following figures.

Many different embodiments may be employed in converting the principles of the present invention into an actual working hardware in constructing a sweeping tubular diaphragm pump or motor. It should be mentioned that a pump can be made to function as a motor and vice versa in most applications and, consequently, it should be understood that a pump is a motor and vice versa even when it is not specifically mentioned so. The illustrations shown in FIGS. 1 through 4 represents a typical embodiment most useful for the explanation of the working principles of a sweeping tubular diaphragm pump or motor constructed in accordance with the principles of the present invention.

Figure 1:
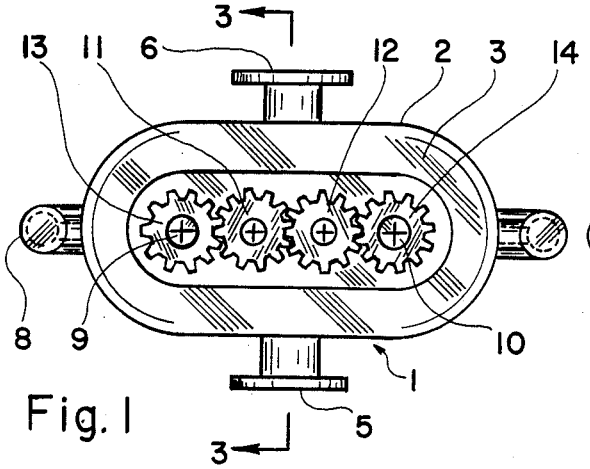
FIG. 1 illustrates an end view of a sweeping tubular diaphragm pump or motor constructed in accordance with the principles of the present invention.
Figure 2:
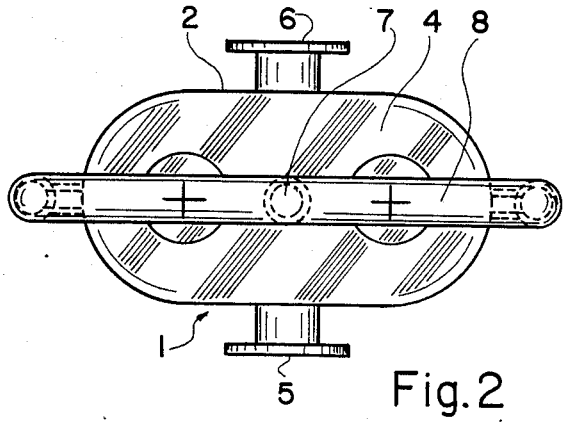
FIG. 2 illustrates the other end view showing the end opposite to the one illustrated in FIG. 1.

There is shown in FIGS. 1 and 2 two opposite end views of a sweeping tubular diaphragm pump or motor 1 comprising a closed rigid cylindrical shell 2 having an oblong circular cross section, which rigid cylindrical shell is closed at two ends by the end walls 3 and 4. A pair of the ports 5 and 6 for the movement of the fluid in and out of the rigid cylindrical shell 2 are disposed through said rigid cylindrical shell at two diametrically opposite positions across the plane including the major axis of said oblong circular cross section. The rigid cylindrical shell 2 further includes a plurality of the holes disposed through the rigid cylindrical shell on the plane including the major axis of said oblong circular cross section which plurality of the holes are connected to the manifolds included in the U-shaped pipe 8. The pipe 8 is branched off and connected to the hole 7 disposed through the center portion of the end wall 4. A pair of the drive shaft 9 and 10 rotating in two opposite directions at the same angular velocity rotatably engage and extend through a pair of holes disposed through the end wall 3 on the plane including the major axis of the oblong circular cross section of the rigid cylindrical shell, which pair of the holes are located at two diametrically opposite positions across the plane including the minor axis of said oblong circular cross section. The drive shafts 9 and 10 are mechanically linked to one another by the gears 13 and 14 nonrotatably mounted on each of two shafts which gears are linked to one another by means of the idler gears 11 and 12.

Figure 3:
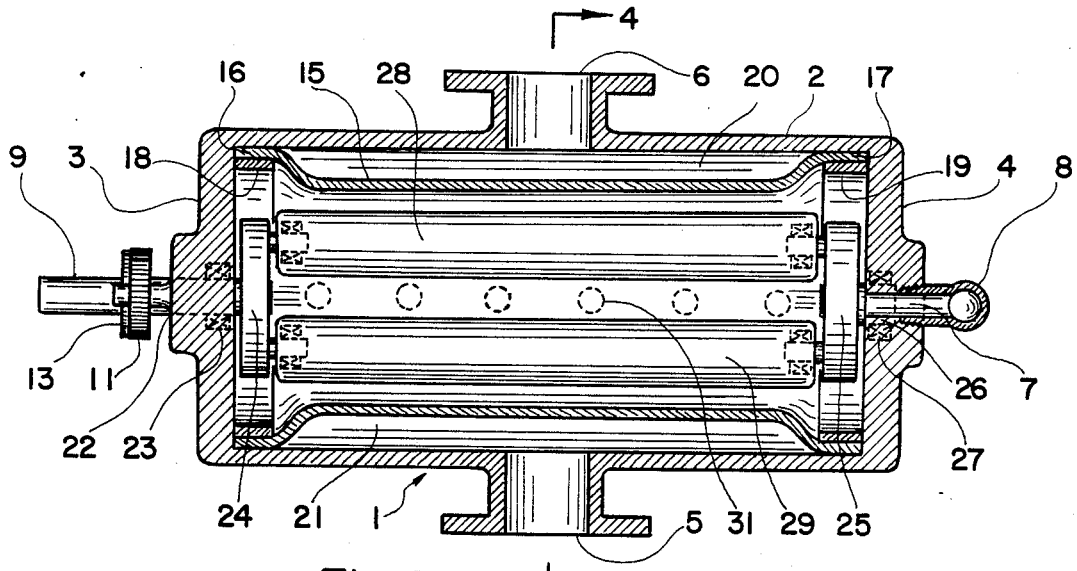
FIG. 3 illustrates a cross section of the sweeping tubular diaphragm pump or motor taken along a plane 3—3 including the central axis of the sweeping tubular diaphragm pump or motor, as shown in FIG. 1.

In FIG. 3 wherein a cross section taken along a plane 3—3 as shown in FIG. 1 is illustrated, there is shown the structures included within the rigid cylindrical shell 2. A flexible tubular shell 15 having the circumferential length at the two extremities substantially equal to that of the rigid cylindrical shell 2 and the circumferential length at the waist portion substantially smaller than that of the rigid cylindrical shell 2, is coaxially disposed within the rigid cylindrical shell 2 wherein its two extremities 16 and 17 are rigidly affixed to the rigid cylindrical shell 2 by means of the pair of the retaining rings 18 and 19 near two end walls 3 and 4 in a leak-proof manner. Consequently, the space within the rigid cylindrical shell 2 is divided into the annular zone 20 and the core zone 21 by the flexible tubular shell 15. It should be understood that the ports 5 and 6 are open to the annular zone 20 while the fluid passage provided by the hole 7, U shaped pipe 8, and the plurality of the holes disposed through the rigid cylindrical shell connects the annular zone 20 and the core zone 21 to one another. The drive shaft 9 engaging and extending through the hole 22 disposed through the end wall 3 engages the bearing 23 and is affixedly connected to a rotating arm 24, which rotating arm extends to two diametrically opposite directions from the center line of the shaft 9. Another rotating arm 25 of the same construction is affixedly mounted on a stub shaft 26 coaxially disposed to the drive shaft 9 and rotatably engaging the bearing 27 affixedly disposed in the end wall 4. Said two rotating arms 24 and 25 revolvably support a pair of the revolving rollers 28 and 29 at their extremities. The plurality of the holes 31 disposed through the rigid cylindrical shell are connected to the manifolds on the U-shaped pipe 8 which is branched off and connected to the hole 7 through the center of the end wall 4; whereby, providing the fluid passage between the annular zone 20 and the core zone 21.

Figure 4:
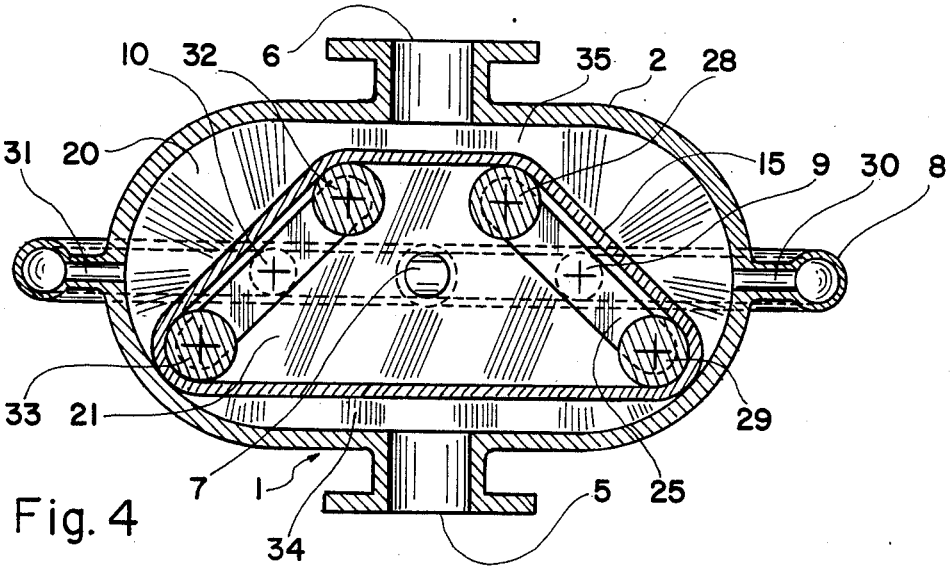
FIG. 4 illustrates a cross section of the sweeping tubular diaphragm pump or motor taken along a plane 4—4 perpendicular to the central axis of said device, as shown in FIG. 3.

In FIG. 4, there is shown a cross section of the sweeping tubular diaphragm pump or motor illustrated in FIG. 3, which cross section is taken along a plane 4—4 as shown in FIG. 3, wherein the entire cross section instead one half of the cross section is shown. In addition to the pair of the revolving rollers 28 and 29, another pair of the revolving rollers 32 and 33 are revolvably supported by another pair of the rotating arms at their extremeties, which another pair of the rotating arms are mounted on the drive shaft 10 and its stub shaft in the same way as the rotating arms 24 and 25 are mounted on the drive shaft 9 and the stub shaft 26. The plurality of the holes 30 and 31 are disposed through the rigid cylindrical shell at two diametrically opposite positions on the plane including the major axis of the oblong circular cross section of the rigid cylindrical shell and connected to the manifolds on the U-shaped pipe 8 which is then connected to the hole 7 through the end wall 4. The distance between the pair of the revolving rollers included in each of two revolving roller assemblies and the distance between the center lines of two drive shafts 9 and 10 are so selected that, firstly, the four revolving rollers stretches the waist section of the flexible tubular shell 15 around them in a substantially tensile state at all the time independent of the particular angular position of the revolving rollers about the drive shafts and, secondly, the gap between the inner surface of the rigid cylindrical shell and the surface of the revolving roller when each of the revolving rollers sweeps around adjacent to the semicircular portion of the rigid cylindrical shell, is substantially equal to the thickness of the flexible tubular shell 15; whereby, when each of the revolving rollers sweeps by the semicircular portion of the rigid cylindrical shell, the flexible tubular shell squeezed therebetween provides substantially leak-proof barrier against the fluid movement through said gap. It should be further mentioned that said two assembly of the revolving rollers rotate in two opposite directions at the same angular velocity and are in phase in their rotating motion wherein one assembly of the revolving rollers is always a mirror image of the other with respect to the plane including the minor axis of the oblong circular cross section of the rigid cylindrical shell.

Figure 9:
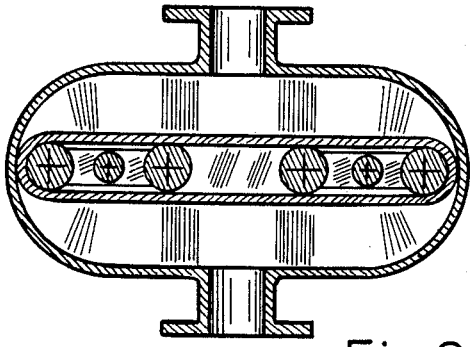
FIG. 9 illustrates a cross section taken along a plane 9—9 as shown in FIG. 8.

With aforementioned description of the sweeping tubular diaphragm pump or motor 1, said device functions in the following principle: Since a motor is a reverse process of a pump, description will be focused on the pump. Let us consider the case wherein the revolving rollers 28 and 29 are rotated about the drive shaft 9 in the counter clockwise direction and revolving rollers 32 and 33 are rotated in the clockwise direction as shown in FIG. 4, which rotation of the revolving rollers is realized by the power input on the mechanical transmission means connected either to the drive shaft 9 or the drive shaft 10. Under said directions of the rotations for the revolving rollers, port 5 is the intake port and port 6 is the discharge port. It should be understood that the annular zone 20 is divided into two zones at most of the time, e.g., the intake-side outer zone 34 and the discharge-side outer zone 35 as shown in FIG. 4. When the each pair of the revolving rollers is rotated slightly past the plane parallel to the minor axis of the oblong circular cross section of the rigid cylindrical shell, the intake-side outer zone has zero volume while the discharge-side outer zone has a volume equal to two semicircular cross section of the annular zone existing at said moment of the rotation of the revolving rollers. As the assemblies of the revolving rollers are rotated to the positions shown in FIG. 4 and, then, to that shown in FIG. 9, the intake-side zone expands and, consequently, the fluid is sucked through the intake port 5, while the combined volume of the discharge-side outer zone and the core zone shrinks and, consequently, the fluid occupying the core zone 21 is forcibly squeezed out into the discharge-side outer zone 35 through the fluid passage provided by the pluralities of the holes 30 and 31, U shaped pipe 8, the hole 7 and, then, forced out through the discharge port 6. When the assemblies of the revolving rollers are further rotated beyond the position as shown in FIG. 9, the core zone 21 and the intake-side outer zone 34 becomes open to one another by means of the fluid passage comprising the pluralities of the holes 30 and 31, U shaped pipe 8, the hole 7. During the next 90 degrees of the rotation of the assemblies of the revolving rollers, the discharge-side outer zone 35 contracts continuously and, consequently, the fluid occupying said zone becomes forcibly discharged through the discharge port 6, while the sum of the volume of the core zone 21 and the intake-side outer zone 34 expands continuously and, consequently, more fluid is sucked into the intake-side outer zone and, then, into the core zone through the intake port 5. As a matter of fact, said pumping action is created by the portion of the flexible tubular shell intermediate two revolving rollers sweeping over the oblong circular cross section of the rigid cylindrical shell in the direction parallel to the minor axis of said oblong circular cross section, which sweeping action is cyclically repeated. It is obvious that the sweeping tubular diaphragm pump 1 of which operating principles has been just described becomes a hydraulic or pneumatic motor when the ports 6 and 7 are connected to the high pressure and low pressure lines, respectively. It should be understood that the plurality of the holes 30 and 31 through the rigid cylindrical shell 2 may be disposed slightly above or below the plane including the major axis of the oblong circular cross section of the rigid cylindrical shell. It should be further understood that the sweeping tubular diaphragm pump or motor operates with the flexible tubular shell of which extremities are left free without being connected to the rigid cylindrical shell, though such an arrangement accompanies a certain amount of backward leak from the contracting zone to the expanding zone in the pumping process. It should be mentioned that the drive shaft 9 and the stub shaft 26 may be integrated to a single shaft extending over the length of the rigid cylindrical shell for the improved strength, which modification is also applicable to integrate the drive shaft 10 and its stub shaft.

Figure 5:
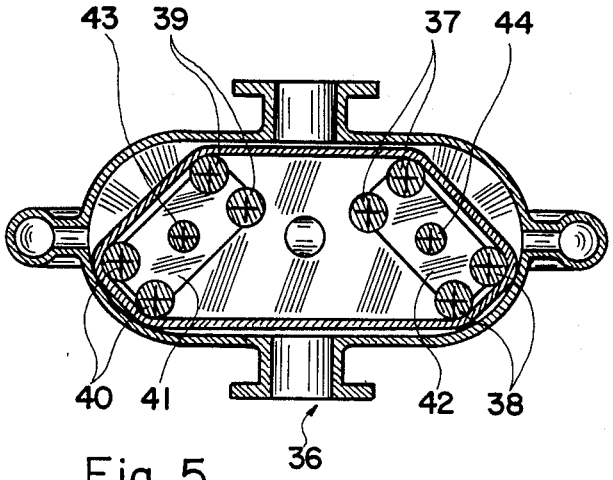
FIG. 5 illustrates a cross section of another embodiment for a sweeping tubular diaphragm pump or motor constructed in accordance with the principles of the present invention, which cross section is taken along a plane perpendicular to the central axis of said device.

In FIG. 5 there is shown a cross section of another embodiment for a sweeping tubular diaphragm pump or motor 36, which cross section is taken along a plane perpendicular to the central axis of said device. The embodiment shown in FIG. 5 has the same structure as that shown in FIG. 4 with the exception of the arrangement of the revolving rollers wherein the combinations of the pair of the rollers 37, 38, 39 and 40 are employed in place of the single rollers 28, 29, 32 and 33 of FIG. 4.

Of course, the assemblies including the pair of the revolving rollers 37-38 and 39-40 are mounted on the rotating arms 41 and 42 rotating about the drive shafts 43 and 44, respectively.

Figure 6:
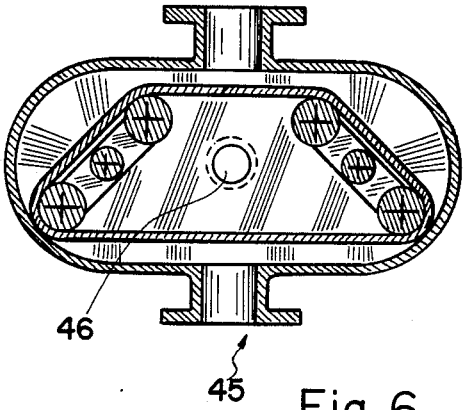
FIG. 6 illustrates a cross section of a further embodiment for a sweeping tubular diaphragm pump or motor taken along a plane perpendicular to the central axis of said device.

In FIG. 6, there is shown a cross section of a further embodiment for a sweeping tubular diaphragm pump 45, which cross section is taken along a plane perpendicular to the central axis of said device. The embodiment 45 has the same construction as that of the sweeping tubular diaphragm pump or motor 1 shown in FIG. 4 with the exception that the fluid passage interconnecting the core zone and the annular zone comprising the pluralities of the holes 30 and 31, the U shaped pipe, and the hole 7 is eliminated. The hole 46 through the center of the end wall 4 is retained to provide a vent opening for the core zone. The embodiment 45 is particularly adaptable to pump a thick particulate media such as the high density slurry even though the pumping efficiency is lower than the embodiments shown in FIGS. 4 and 5.

Figure 7:
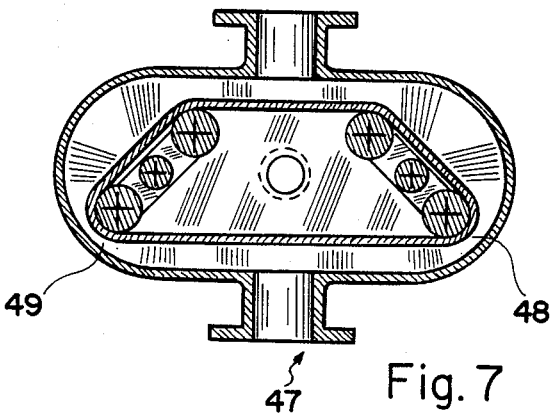
FIG. 7 illustrates a cross section of yet another embodiment for a sweeping tubular diaphragm pump or motor taken along a plane perpendicular to the central axis of said device.

There is shown in FIG. 7 a cross section of yet another embodiment 47 for a sweeping tubular diaphragm pump, which cross section is taken along a plane perpendicular to the central axis of said device. The embodiment 47 is essentially same as that of 45 shown in FIG. 6 with the exception that the gaps 48 and 49 are incorporated intermediate the inner surface of the semicircular portion of the rigid cylindrical shell and the outer surface of the flexible tubular shell wrapping around the revolving rollers sweeping by. This embodiment is recommended to be used as a mixer-pump for mixing and agitating the highly concentrated particulate media.

Figure 8:
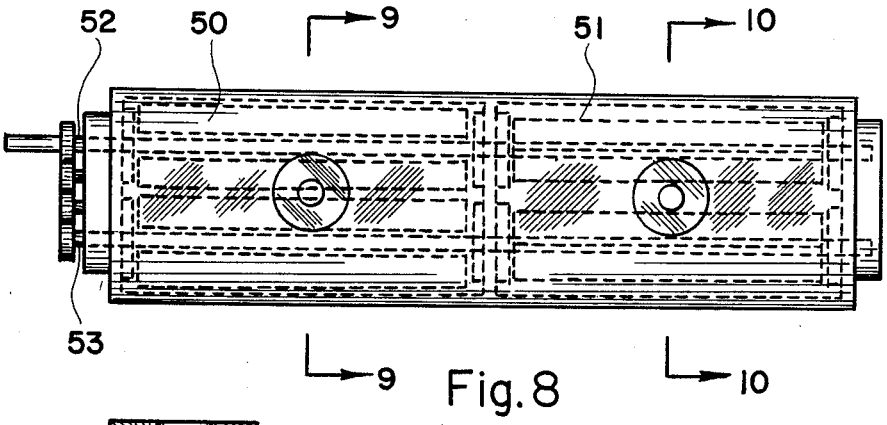
FIG. 8 illustrates a plan view of two sweeping tubular diaphragm pump or motor coupled in series employing the common drive shafts.

There is shown in FIG. 8 a series arrangement of two sweeping tubular diaphragm pumps or motors 50 and 51 employing a pair of common driving shafts 52 and 53 on which the rotating arms with the revolving rollers of the construction equivalent to that of FIGS. 4 or 5 or 6 or 7 are mounted for both units. Such a series arrangement provides an advantage in smoothing out the fluctuating pumping or torque output when a suitable phase difference in the rotating motion of the revolving rollers between two units is employed.

Figure 10:
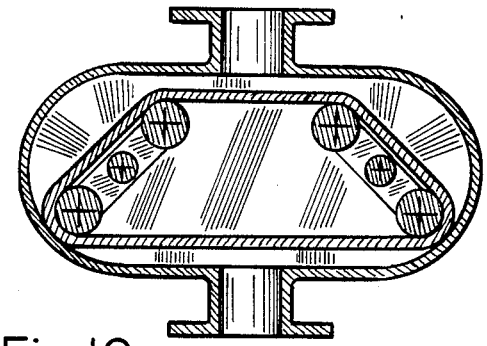
FIG. 10 illustrates a cross section taken along a plane 10—10 as shown in FIG. 8, which shows the difference in the phase angle relative to that of FIG. 9.

For example, a phase difference of 45 degrees between two units coupled in a series as shown in FIG. 8 or in parallel may be employed, which phase difference is illustrated in the FIGS. 9 and 10 showing the cross sections taken along the planes 9—9 and 10—10, respectively, as shown in FIG. 8. Of course, two or more units can be coupled in series or in parallel with more finely proportioned phase difference between different units to obtain more constant output in the pumping or torque.

While the principles of the present invention have now been made clear by the illustrative embodiments, there will be immediately obvious to the skilled in the art many modifications of the elements, structures, proportions and material particularly adapted to the specific working environment and the operating condition without departing from those principles.

I claim:

1. A sweeping tubular diaphragm pump or motor comprising:

(a) a closed rigid cylindrical shell having an oblong circular cross section including a pair of semicircular sections at two extremities of said oblong circular cross section;

(b) a first drive shaft rotatably disposed substantially along the center line of the first semicircular section included in said oblong circular cross section of said closed rigid cylindrical shell;

(c) a first pair of rollers disposed substantially parallel to and axisymetrically about said first drive shaft within said closed rigid cylindrical shell wherein each of said first pair of rollers is revolvable about its own axis and rotates with said first drive shaft;

(d) a second drive shaft rotatably disposed substantially along the center line of the second semicircular section included in said oblong circular cross section of said closed rigid cylindrical shell;

(e) a second pair of rollers disposed substantially parallel to and axisymmetrically about said second drive shaft within said closed rigid cylindrical shell wherein each of said second pair of rollers being revolvable about its own axis rotates with said second drive shaft at the same angular speed as said first drive shaft and in the opposite direction to said first drive shaft in a phase substantially equal to the mirror image of said first pair of rollers with respect to a plane including the minor axis of said oblong circular cross section of said closed rigid cylindrical shell;

(f) a flexible tubular shell disposed within said closed rigid cylindrical shell in a substantially coaxial relationship and stretched around said first and second pairs of the rollers wherein the thickness of said flexible tubular shell is substantially matched to the minimum gap between the inside surface of each of said pair of semicircular sections included in said oblong circular cross section of said closed rigid cylindrical shell and the surface of each of said rollers located adjacent to said inside surface of each of said pair of semicircular section;

(g) a first port including at least one opening through said closed rigid cylindrical shell disposed intermediate said first and second semicircular section included in said oblong circular cross section of said closed rigid cylindrical shell;

(h) a second port including at least one opening disposed through a section of said closed rigid cylindrical shell diametrically opposite to said first port;

(i) a mechanical transmission means for transferring power to said first or second drive shaft or both of said first and second drive shafts; and (j) one or more holes through said closed rigid cylindrical shell disposed at each of two diametrically opposite sides on a plane substantially including the major axis of said oblong circular cross section of said closed rigid cylindrical shell wherein said holes are connected to a conduit connected to the interior zone enclosed by said flexible tubular shell.

2. A sweeping tubular diaphragm pump or motor comprising:

(a) a closed rigid cylindrical shell having an oblong circular cross section including a pair of semicircular sections at two extremities of said oblong circular cross section;

(b) a first drive shaft rotatably disposed substantially along the center line of the first semicircular section included in said oblong circular cross section of said closed rigid cylindrical shell;

(c) a first pair of rollers disposed substantially parallel to and axisymmetrically about said first drive shaft within said closed rigid cylindrical shell wherein each of said first pair of rollers in revolvable about its own axis and rotates with said first drive shaft;

(d) a second drive shaft rotatably disposed substantially along the center line of the second semicircular section included in said oblong circular cross section of said closed rigid cylindrical shell;

(e) a second pair of rollers disposed substantially parallel to and axisymmetrically about said second drive shaft within said closed rigid cylindrical shell wherein each of said second pair of rollers being revolvable about its own axis rotates with said second drive shaft at the same angular speed as said first drive shaft and in the opposite direction to said first drive shaft in a phase substantially equal to the mirror image of said first pair of rollers with respect to a plane including the minor axis of said oblong circular cross section of said closed rigid cylindrical shell;

(f) a flexible tubular shell disposed within said closed rigid cylindrical shell in a substantially coaxial relationship and stretched around said first and second pairs of the rollers wherein the thickness of said flexible tubular shell is substantially less than the gap between the inside surface of each of said pair of semicircular sections included in said oblong circular cross section of said closed rigid cylindrical shell and the surface of each of said rollers located adjacent to said inside surface of each of said pair of semicircular section;

(g) a first port including at least one opening through said closed rigid cylindrical shell disposed intermediate said first and second semicircular sections included in said oblong circular cross section of said closed rigid cylindrical shell;

(h) a second port including at least one opening disposed through a section of said closed rigid cylindrical shell diametrically opposite to said first port; and (i) a mechanical transmission means for transferring power to said first or second drive shaft or both of said first and second drive shafts.

* * * * *